US010381147B2

(12) United States Patent
Ettl

(10) Patent No.: US 10,381,147 B2
(45) Date of Patent: Aug. 13, 2019

(54) CONTAINER ARRANGEMENT FOR POWER TRANSFORMERS

(71) Applicant: SIEMENS AKTIENGESELLSCHAFT, Munich (DE)

(72) Inventor: Christian Ettl, Weiz (AT)

(73) Assignee: Siemens Aktiengesellschaft, Munich (DE)

( * ) Notice: Subject to any disclaimer, the term of this patent is extended or adjusted under 35 U.S.C. 154(b) by 19 days.

(21) Appl. No.: 15/159,349

(22) Filed: May 19, 2016

(65) Prior Publication Data

US 2017/0316860 A1 Nov. 2, 2017

(30) Foreign Application Priority Data

Apr. 29, 2016 (DE) ..... 10 2016 207 331

(51) Int. Cl.

| | |
|---|---|
| ***H01F 27/02*** | (2006.01) |
| ***H01F 27/00*** | (2006.01) |
| ***H01F 30/12*** | (2006.01) |

(52) U.S. Cl.
CPC ..... *H01F 27/02* (2013.01); *H01F 27/002* (2013.01); *H01F 30/12* (2013.01)

(58) Field of Classification Search
CPC ..... H01F 27/02; H01F 27/06
See application file for complete search history.

(56) References Cited

U.S. PATENT DOCUMENTS

| | | | | |
|---|---|---|---|---|
| 3,235,823 | A | 2/1966 | Renberg, Jr. | |
| 9,608,500 | B2 * | 3/2017 | McCartney | H02K 5/00 |
| 2010/0090543 | A1 * | 4/2010 | Cobb | H01F 27/002 307/149 |

(Continued)

FOREIGN PATENT DOCUMENTS

| | | |
|---|---|---|
| EP | 2528072 A1 | 11/2012 |
| GB | 2466192 A | 4/2010 |

(Continued)

OTHER PUBLICATIONS

Yamada S et al., "Recent technical development of site-assembly transformer", IEEE/PES Transmission and Distribution Conference and Exhibition 2002: Asia Pacific. Yokohama, Japan, Oct. 6-10, 2002; [IEEE/PES Transmission and Distribution Conference and Exposition], New York, NY: IEEE, US, vol. 3, (Oct. 6, 2002), pp. 1824-1828, XP010630160, DOI: 10.1109/TDC.20021177733, ISBN:978-0-7803-7525-3.

*Primary Examiner* — Hoa C Nguyen
*Assistant Examiner* — Amol H Patel
(74) *Attorney, Agent, or Firm* — Laurence Greenberg; Werner Stemer; Ralph Locher

(57) ABSTRACT

A container arrangement for power transformers that are constructed from individual components. The components are releasably connected to one another in such a way that simple mounting/demounting and separate transportation is made possible. At least some of the components are arranged in containers, wherein each container contains a predetermined type of components in such a way that the components necessary for intended construction variants of the power transformers at the use location are contained in a corresponding selection of containers. This renders possible the correct and efficient mounting of power transformers.

3 Claims, 1 Drawing Sheet

(56) References Cited

U.S. PATENT DOCUMENTS

| | | | | |
|---|---|---|---|---|
| 2011/0298287 | A1 | 12/2011 | Cobb et al. | |
| 2013/0083476 | A1 | 4/2013 | Clidaras et al. | |
| 2014/0077913 | A1 | 3/2014 | Weber et al. | |
| 2016/0241156 | A1* | 8/2016 | Kawakami ..... | H02M 7/003 |
| 2017/0279251 | A1 | 9/2017 | Leber | |

FOREIGN PATENT DOCUMENTS

| | | | |
|---|---|---|---|
| JP | S57133609 | A | 8/1982 |
| WO | 2016041566 | A1 | 3/2016 |

* cited by examiner

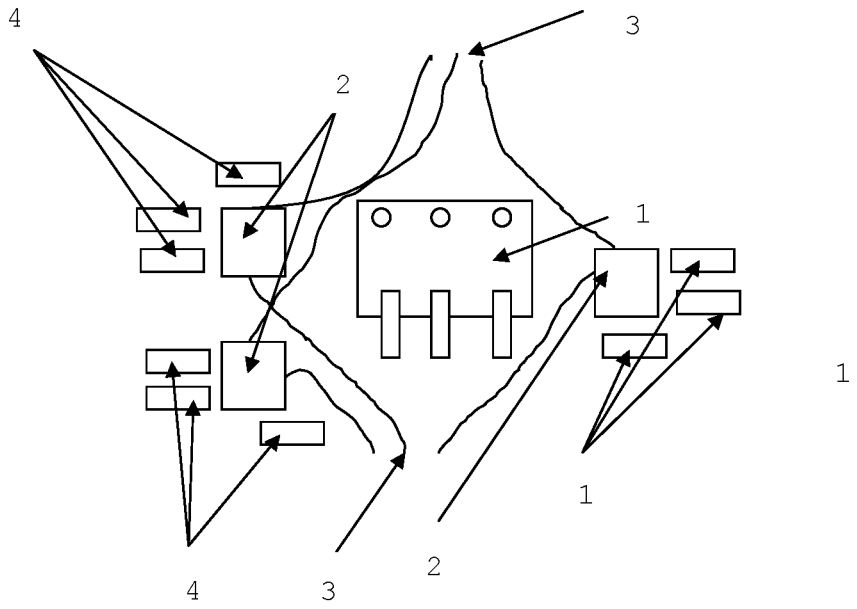
4
3
2
1
1
1
4
3
2

CONTAINER ARRANGEMENT FOR POWER TRANSFORMERS

BACKGROUND OF THE INVENTION

Field of the Invention

The invention relates to a container arrangement for power transformers.

Power transformers are used in energy supply networks for voltage conversion. They are typically configured as three-phase alternating current transformers, wherein the three individual transformers necessary for transformation in a three-phase system are structurally combined to form a single assembly.

The basic requirement of all power transformers is to supply energy efficiently and reliably to the consumer. In this context, each individual transformer is a tailor-made individually manufactured item designed on the basis of individual factors such as voltage, power, climate, network topography, noise level and much more besides.

Since the power transformers thus constitute key components of electrical power transmission, the failure thereof constitutes a considerable threat to the stability of the energy supply network affected.

This is particularly also so because the replacement of a tailor-made transformer necessarily requires a corresponding individual manufacturing process, transportation to the location where it is to be set up and mounting. Experience has shown that the time frame required for this can be over a year.

The prior art discloses so-called mobile plug and play transformers which are suitable for quick replacement of failed transformers.

These transformers are particularly lightweight and compact so as to facilitate transportation. Moreover, importance is placed on simple installability for such transformers.

BRIEF SUMMARY OF THE INVENTION

Therefore, the object on which the invention is based is to further simplify the installation of power transformers.

According to the invention, this is achieved by a container arrangement as claimed.

Advantageous embodiments will become apparent from the subclaims.

BRIEF DESCRIPTION OF THE DRAWING

The invention is explained in more detail with reference to a FIGURE which schematically shows the arrangement of a replacement transformer.

DESCRIPTION OF THE INVENTION

Transformers typically comprise as main components the actual transformer, a cooling system, an expansion vessel, insertable lead-throughs, an additional transformer for supplying electrical power to the cooling systems, and cable connections.

In the case of replacement transformers 2, the stated components or modules are releasably connected to one another, with the result that simple demounting and separate transportation is possible.

During the replacement of a failed transformer 1, which is intended to take place as quickly as possible, that is to say within a few days, preferably within 48 hours, the failed transformer 1 is not removed for now since dismantling is associated with a time delay, but the replacement transformer 2 is set up in the vicinity, and the stated individual components are connected to one another and to the energy supply network.

It is only when this replacement solution is functioning that the faulty transformer 1 is disassembled and replaced by a custom-made transformer.

When replacing a failed multiphase transformer 1, it is expedient, moreover, if, for each phase of the failed multiphase transformer 1, a single-phase transformer 2 is provided and set up and mounted in the surroundings.

Setting up the replacement transformers 2 in the surroundings of the failed transformer 1 is accompanied by a considerable time saving, but requires increased flexibility in the connection of the components. In particular, the cable connections must be adapted to the local conditions.

According to the invention, the components, in particular the parts of the cable connections, that is to say the cables themselves, and cable drums, cable unspooling devices, cable supports, insertable lead-throughs, but also small and reserve parts, tools, test and adapter plugs, connection pipelines for the cooling system, rising pipes and surge arresters are mounted in containers 4 such that, after determining an intended construction variant of a replacement power transformer 2, all the necessary components are contained in a corresponding container selection for a use, and it is ensured, by dispatching these containers 4 to the use location, that all the necessary components are also present for mounting purposes.

It is also advantageous here if the arrangement of the containers 4 at the use location is adapted to the arrangement of the replacement transformer 2 such that thus the components or the containers 4 accommodating them are already arranged in spatial proximity to their target position or the associated connections 3.

The mounting sequences can thus be optimized and the mounting operation can be further accelerated.

Thus, in the case of use, it is decided prior to dispatch of the transformers 2 and the accessories which construction variants must be implemented, for example, in a substation. The containers 4 are then correspondingly transported with the necessary accessories to the substation and arranged in an optimized manner there if the spatial conditions allow.

It may also be expedient if at least some of the containers 4 remain at the use location during the operation of the power transformer 2 and thereby serve as protection for the components or parts thereof arranged therein.

LIST OF REFERENCE SIGNS

1 Failed transformer (three-phase)
2 Replacement transformers (single-phase)
3 Connections to energy supply network
4 Containers

The invention claimed is:

1. A method of mounting a power transformer as a temporary replacement for a failed transformer, the method comprising:

in a first step, determining a construction variant of the power transformer to be assembled at a use location;

subsequently selecting certain containers in accordance with the construction variant determined in the first step;

dispatching the selected certain containers and remaining components to the use location; and mounting the power transformer in the predetermined design variant at the use location; and performing the step of mounting the power transformer in the predetermined design variant at the use location before removing the failed transformer.

2. The method according to claim 1, which comprises placing and arranging the containers at the use location to thereby minimize cost and complexities of a mounting operation.

3. The method according to claim 1, which comprises: after the power transformer has been mounted and is functioning, replacing the failed transformer with a transformer.

* * * * *